US006742725B1

(12) United States Patent
Fan

(10) Patent No.: US 6,742,725 B1
(45) Date of Patent: Jun. 1, 2004

(54) MULTI-NOZZLE SHOWERHEAD

(76) Inventor: Chen-Yueh Fan, Room F/23, 4th Fl., No. 5, Sec. 5, Hsinyi Rd., Taipei (TW)

( * ) Notice: Subject to any disclaimer, the term of this patent is extended or adjusted under 35 U.S.C. 154(b) by 0 days.

(21) Appl. No.: 10/384,678

(22) Filed: Mar. 11, 2003

(51) Int. Cl.[7] ..... B05B 7/02

(52) U.S. Cl. ..... 239/525; 239/550; 239/536; 239/548; 239/562; 239/447

(58) Field of Search ..... 239/525, 436, 239/390, 550, 536, 548, 552, 553, 557, 558, 562, 446, 448, 450, 381, 99, 447; 4/601, 615, 605, 678

(56) References Cited

U.S. PATENT DOCUMENTS 4,865,254 A * 9/1989 Kragle ..... 239/76
6,227,456 B1 * 5/2001 Colman ..... 239/1
D473,285 S * 4/2003 Fan ..... D23/213
D483,837 S * 12/2003 Fan ..... D23/213

* cited by examiner

*Primary Examiner*—Dinh Q. Nguyen
(74) *Attorney, Agent, or Firm*—Fei-Fei Chao; Venable LLP

(57) ABSTRACT

A multi-nozzle showerhead has a showerhead housing, a rectangular tube, multiple nozzles and a connector. The showerhead housing has a nozzle recess for each nozzle. Each of the nozzles has a diffuser, a radial impeller, a circular impeller, a diffuser housing, a selection valve, seals and a fastener. The fastener has a threaded bolt and a nut. The seals are securely mounted in each of the nozzles to prevent water leakage. Each of the nozzles is held together by the fastener with the threaded bolt and nut. The radial impeller has multiple fins, and one of the fins is an interrupt fin that momentarily interrupts the flow of water to the diffuser.

10 Claims, 10 Drawing Sheets

MULTI-NOZZLE SHOWERHEAD

BACKGROUND OF THE INVENTION

1. Field of the Invention

The present invention relates to a showerhead, and more particularly to a multi-nozzle showerhead where each of the multiple nozzles has an impeller and a circular impeller that creates a pulsating water pattern.

2. Description of Related Art

With reference to FIG. 8 and 9, a conventional showerhead comprises a head (40), a button (44) and a nozzle (50).

The head (40) is a hollow cylinder and comprises an outer circular surface (not numbered), a front opening (not numbered), a hollow handle (42), a protrusion (41) and a side recess (46). The hollow handle (42) is connected to a water source (not shown) and has a top opening (not numbered). The head (40) is securely mounted on the top opening of the hollow handle (42). The protrusion (41) has a threaded outer circular surface (not numbered) and is formed around the front opening in the head (40). The side recess (46) is formed in the outer circular surface of the head (40) and has an inner bracket (not numbered) with external detents (not numbered). The inner bracket has an external circular surface (not numbered), multiple radial teeth (not numbered) and a circular axial through hole (not numbered). The multiple radial teeth are formed on the external circular surface of the inner bracket to form the external detents. The circular axial through hole extends from the front opening of the head (40) through the side recess (46).

The button (44) has a front surface (not numbered), a rear surface (not shown), a recess (442) and a key cylinder (446). The recess (442) has a rib (444), extends into the button (44) through the front surface and aligns with the key (446). The key cylinder (446) is circular, is formed in the recess (442) in the button (44) flush with the rear surface and has a keyhole (not numbered). The rib (444) in the recess (442) is formed between the front surface and the key cylinder (446) and engages the detents when the button (44) is slideably mounted in the side recess (46).

The nozzle (50) comprises a moveable flapper valve (51), a diffuser (53), a diffuser housing (55) and a retaining ring (57).

The moveable flapper valve (51) comprises a flapper disk (510), a front surface (not numbered), a rear surface (not numbered), a stud (514) and a pin (515). The stud (514) is formed on the rear surface of the moveable flapper valve (51), has a rectangular key (not numbered) that corresponds to the keyhole in the key cylinder (446) and is mounted through the inner bracket. The rectangular key is mounted in the keyhole in the key cylinder (446) to pivotally hold the button (44) in the side recess (46). The pin (515) is formed on the front surface of the moveable flapper valve (51). The flapper disk (510) has an inner portion (not numbered), a middle portion (not numbered), an outer portion (not numbered), an inner aperture (511), a middle aperture (512) and an outer aperture (513). The inner, middle and outer apertures (511, 512, 513) extend through the inner, middle and outer portion of the flapper disk (510).

The diffuser (53) comprises a seal (not numbered), a front surface (not numbered), a circular groove (not numbered), a diffuser recess (not numbered), a rear surface (not numbered), a front lip (not numbered), a rear lip (not numbered), an inner aperture (531), a middle aperture (532) and outer apertures (533). The front surface has an inner portion (not numbered), a middle portion (not numbered) and an outer portion (not numbered). The inner aperture (531) extends through the inner portion of the front surface. The middle aperture (532) extends through the middle portion of the front surface. Each outer aperture (533) extends through the outer portion of the front surface of the diffuser (53). The circular groove is formed between the inner and outer lips of the diffuser (53), and the seal is securely mounted in the circular groove in the diffuser (53). The diffuser recess is formed on the rear surface of the diffuser (53) and comprises at least one notch (not numbered). The pin (515) is mounted selectively in each one of the notches to pivotally connect the moveable flapper valve (51) to the diffuser (53). The rear surface of the diffuser (53) is mounted in the protrusion (41) in the head (40).

The diffuser housing (55) comprises a front surface (not numbered), a lip (not numbered), a rear surface (not numbered), an inner protrusion (not numbered), an outer protrusion (not numbered), at least one outer aperture (not numbered) and a circular impeller (551). The inner and outer protrusions protrude from the rear surface of the diffuser housing (55). The lip is formed on the rear surface of the diffuser housing (55). The circular impeller (551) is rotatably mounted in the diffuser housing (55) between the inner and outer protrusions. The at least one outer aperture extends through the diffuser housing (55) between the lip and the outer protrusions. The rear surface of the diffuser housing (55) is mounted against the diffuser (53), and the diffuser (53) rotates with the diffuser housing (55).

The retainer ring (57) comprises a front flange (not numbered), a seal (not numbered) and a threaded ring body (not numbered). The seal is mounted in the retainer ring (57) between the front flange and the threaded ring body. The retainer ring (57) connects to the nozzle by screwing onto the threaded outer circular surface of the protrusion (41).

With further reference to FIG. 10, water passes through the inner portion of the diffuser (53) when the two inner apertures (511, 531) are aligned with each other. With further reference to FIG. 11, water passes through the middle portion of the diffuser (53) when the two middle apertures (512, 532) are aligned with each other. With further reference to FIG. 12, water passes through the outer portion of the diffuser (53) when the two outer apertures (513, 533) are aligned with each other. The aligning movement of the moveable flapper valve (51) is controlled by engagement of the rectangular key on the stud (514) with the keyhole in the key cylinder (446).

When the showerhead is in use, water passes through the nozzle of the showerhead and diverges to cover a small area. The showerhead has limited selectable water patterns depending on the different portion of the diffuser through the water passes. Therefore, the conventional single nozzle showerhead has disadvantages including limited water pattern options and a small coverage area.

To overcome the shortcomings, the present invention provides a multi-nozzle showerhead to mitigate or obviate the aforementioned problems.

SUMMARY OF THE INVENTION

The primary objective of the present invention is to provide a multi-nozzle showerhead that has selectable water patterns and broader coverage.

To accomplish the foregoing objective, the present invention provides multiple nozzles and multiple impellers to create a large shower coverage and a selectable pulsating water pattern.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
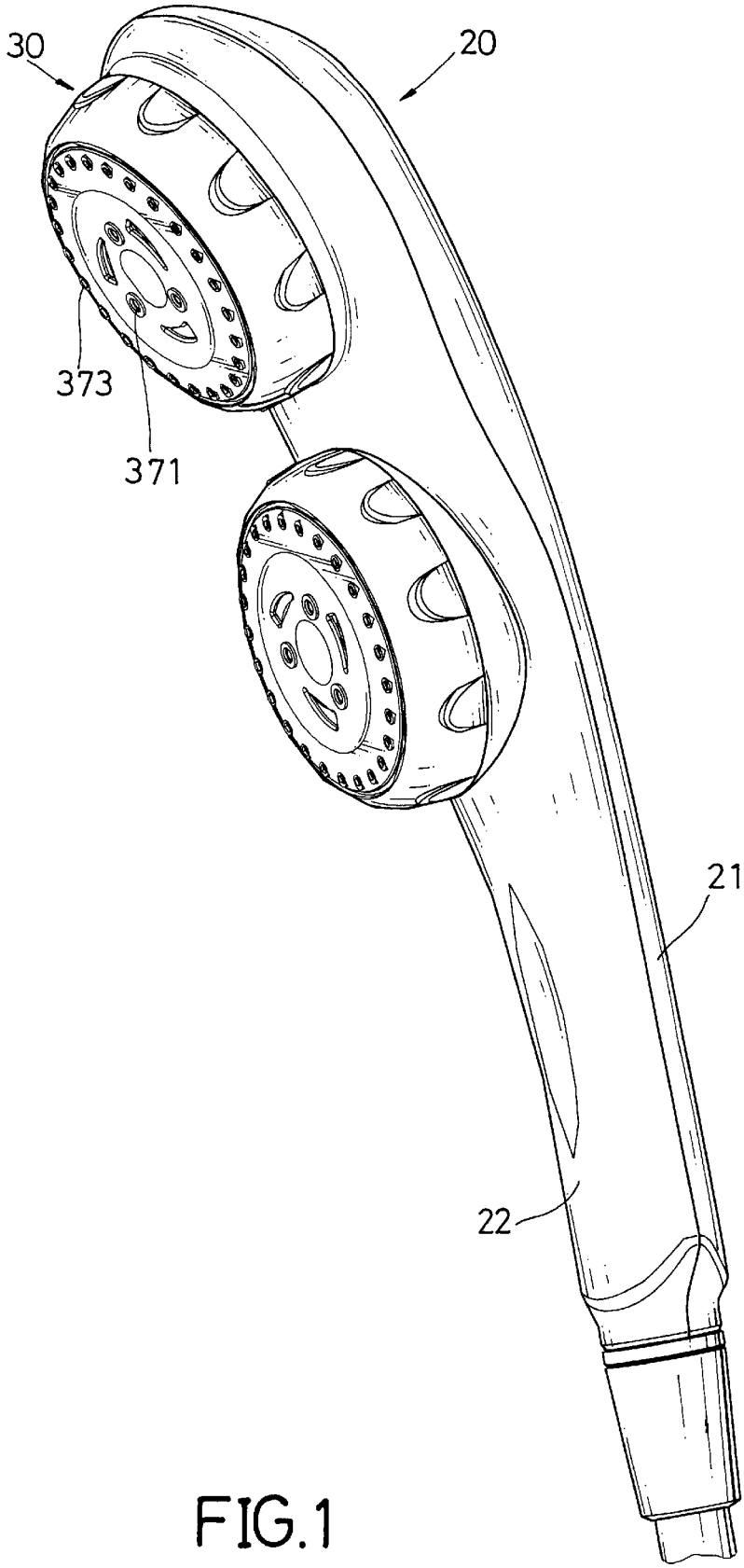
FIG. 1 is a perspective view of a multi-nozzle showerhead in accordance with the present invention.
Figure 2:
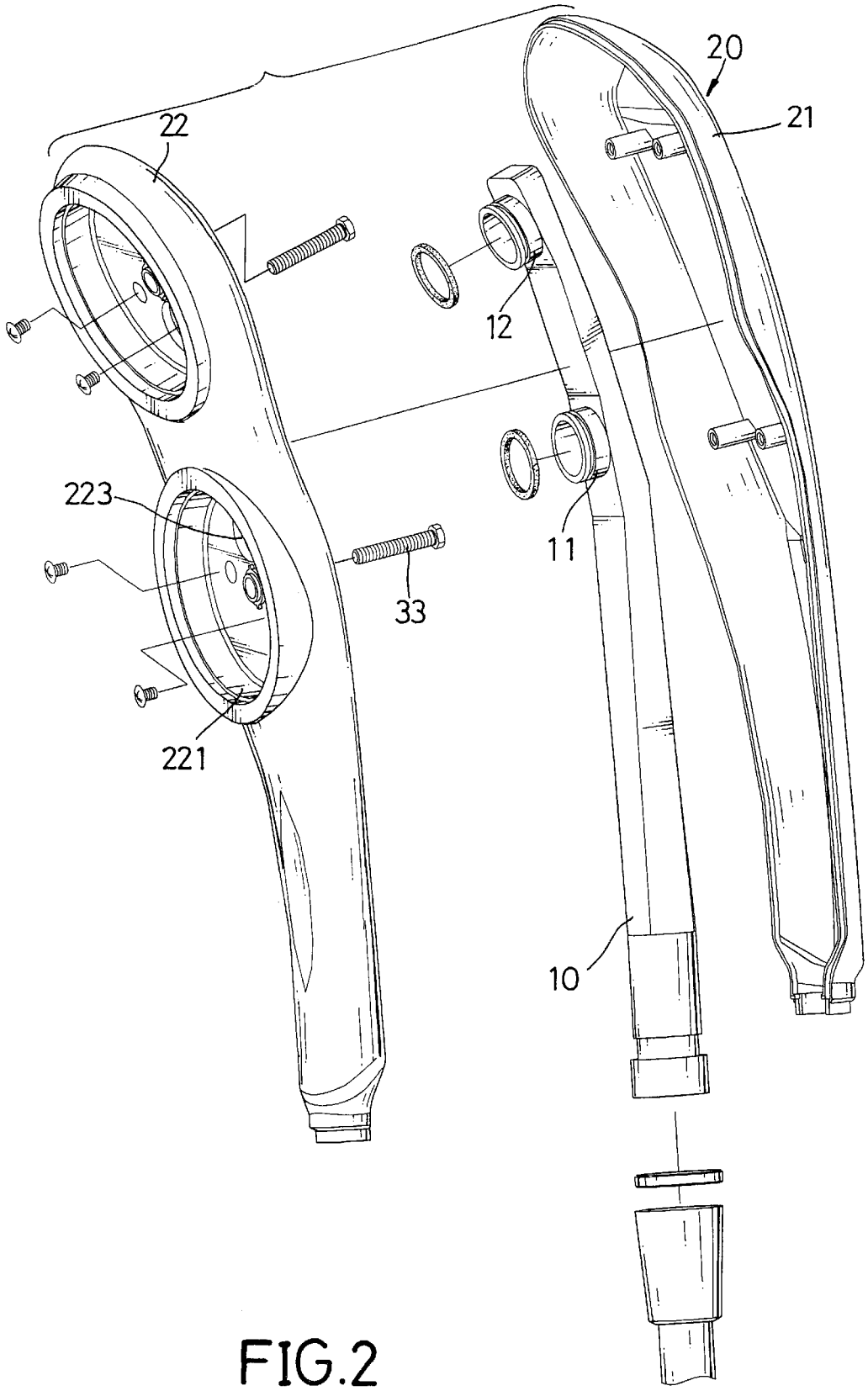
FIG. 2 is an exploded perspective view of the showerhead housing of the multi-nozzle showerhead in FIG. 1.
Figure 3:
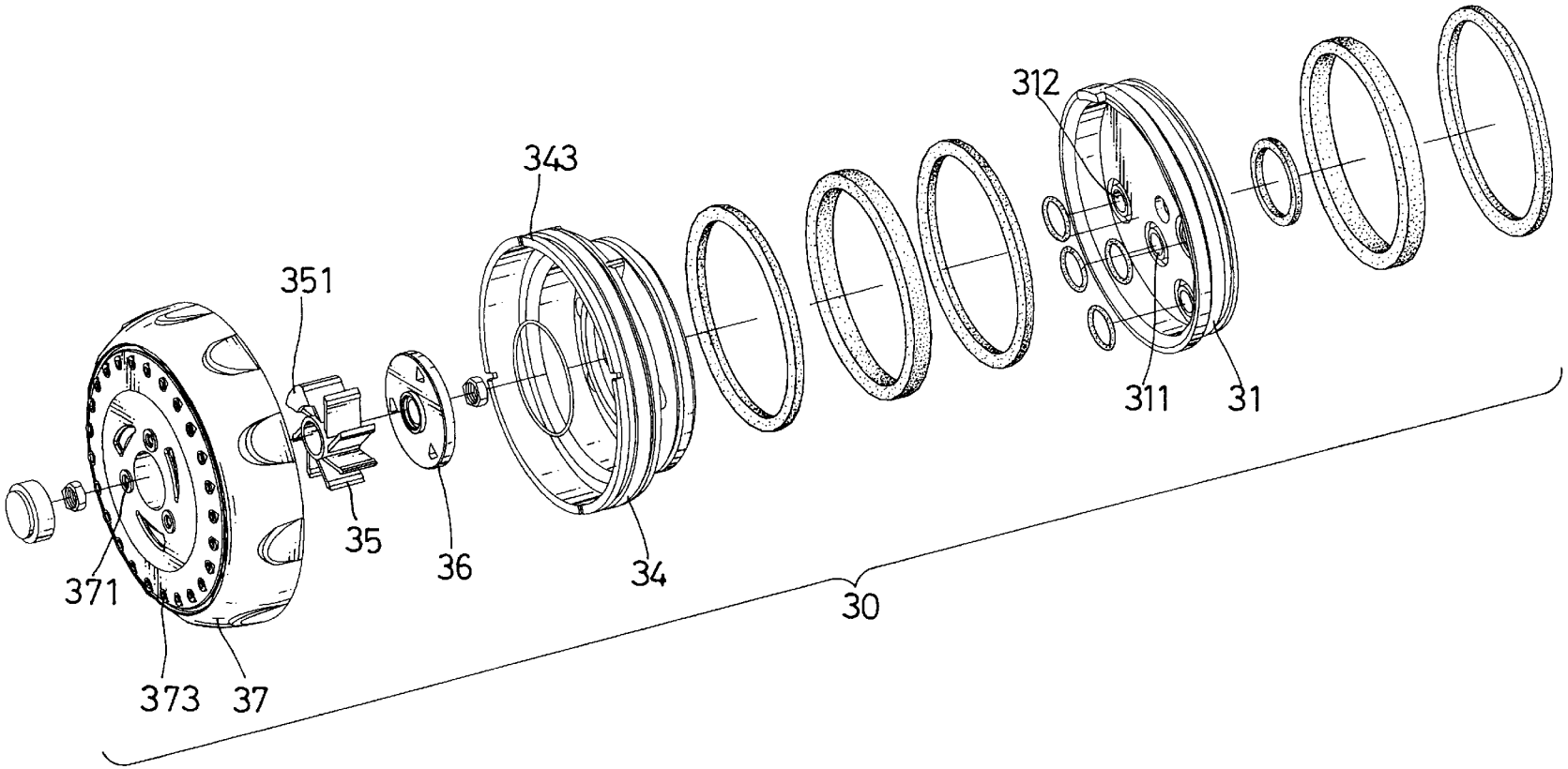
FIG. 3 is an exploded perspective view for a nozzle of the multi-nozzle showerhead in FIG. 1.
Figure 4:
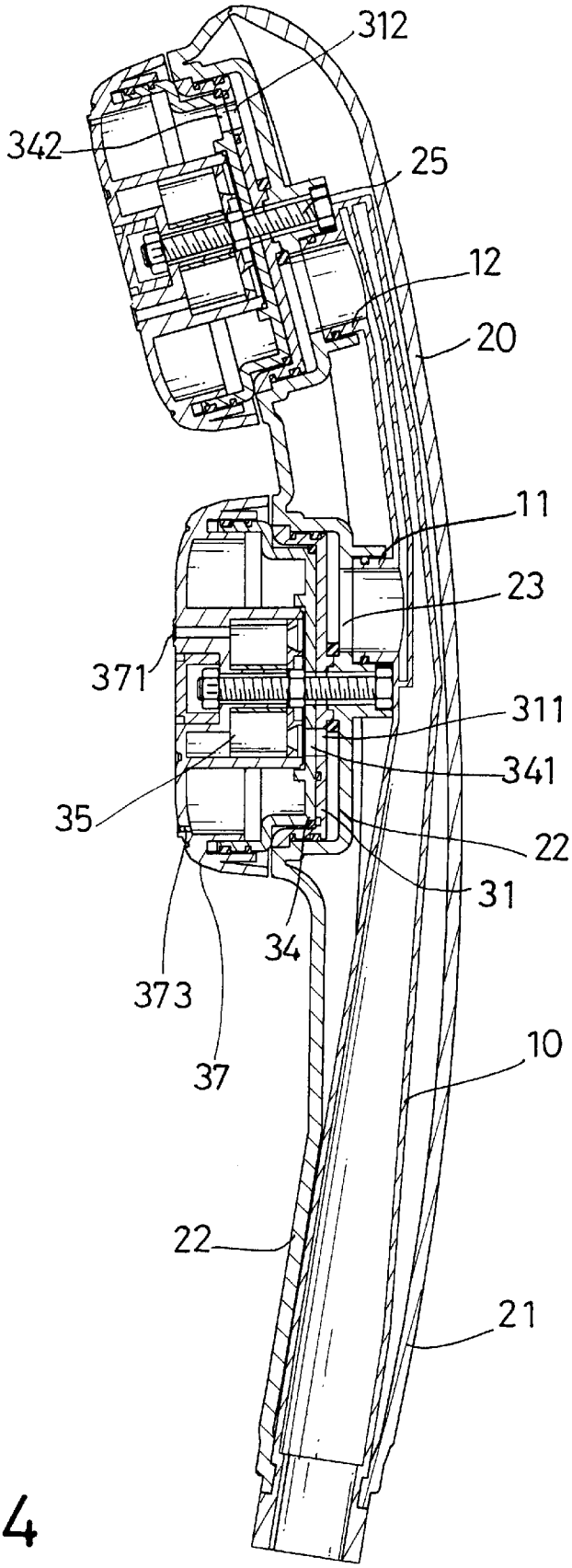
FIG. 4 is a side plan view of the multi-nozzle showerhead in FIG. 1.
Figure 5:
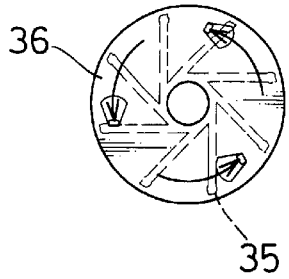
FIG. 5 is a front plan view of a circular impeller and impeller in FIG. 3.
Figure 6:
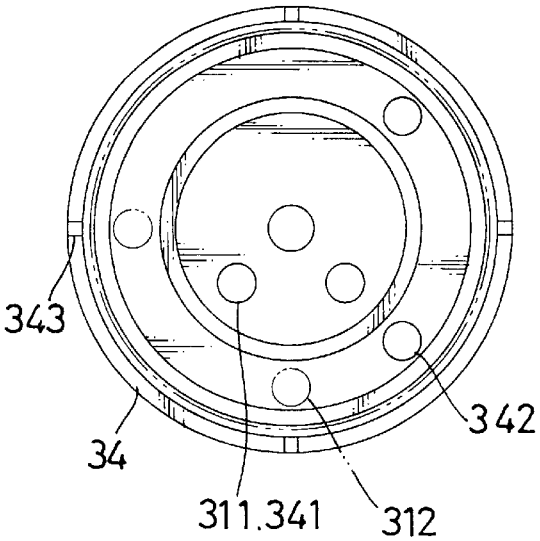
FIG. 6 is a front plan view of a diffuser housing and a selection valve in FIG. 3 with water coming out of the inner through holes.
Figure 7:
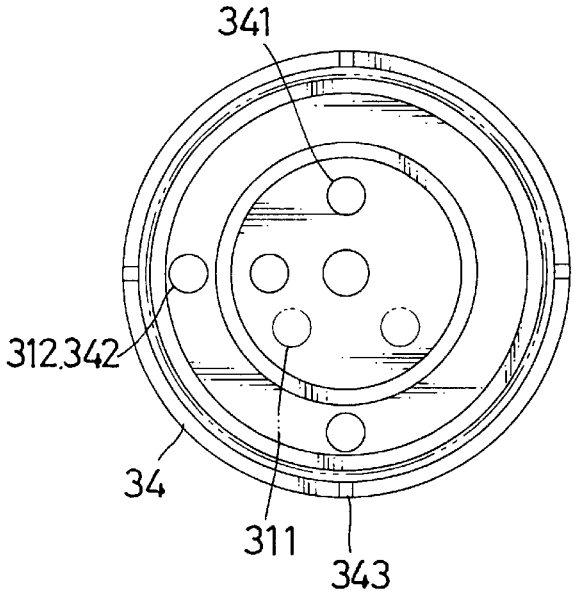
FIG. 7 is a front plan view of the diffuser housing and the selection valve in FIG. 3 with water coming out of the outer through holes.
Figure 8:
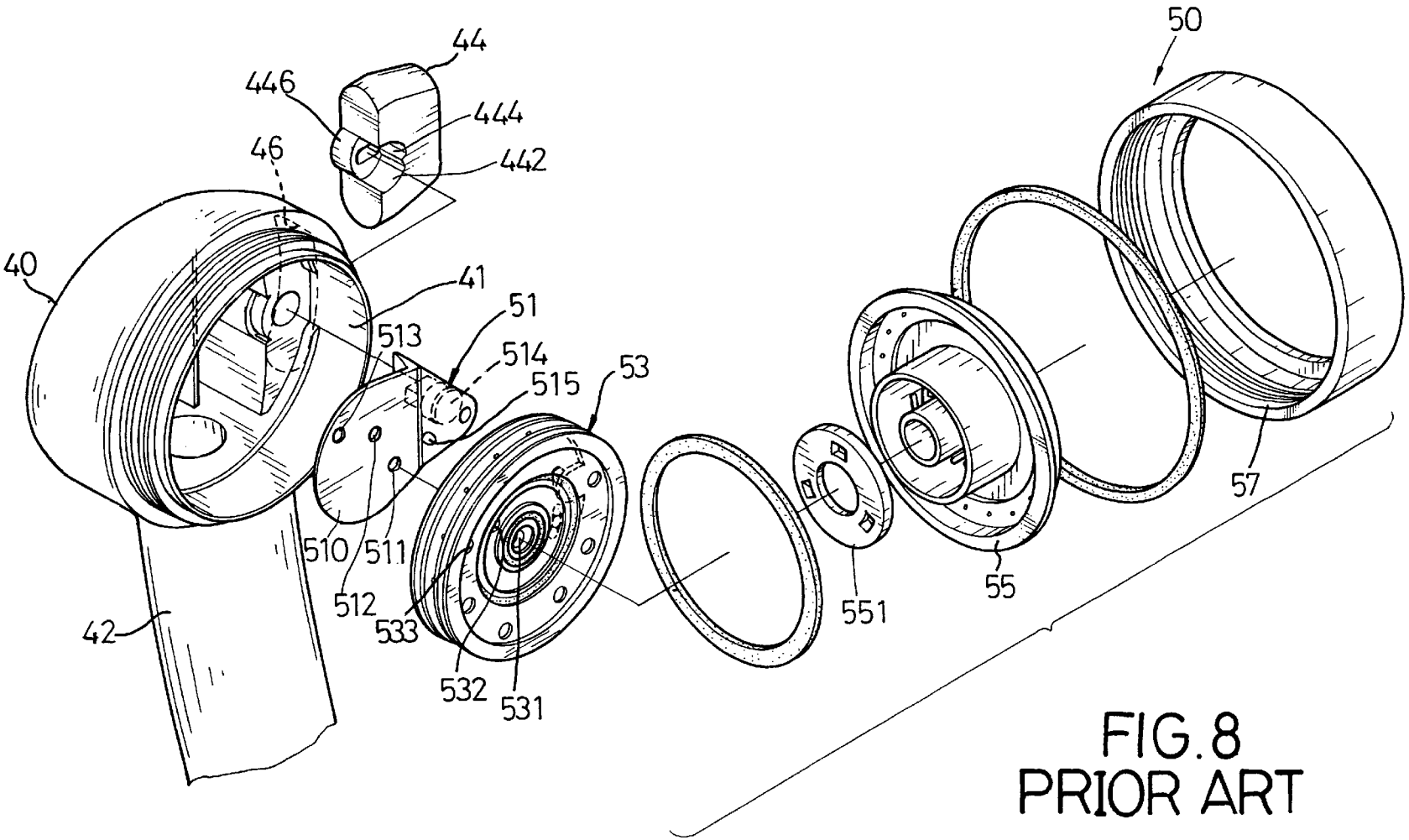
FIG. 8 PRIOR ART
FIG. 8 is an exploded perspective view of a conventional single nozzle showerhead in accordance with the prior art.
Figure 9:
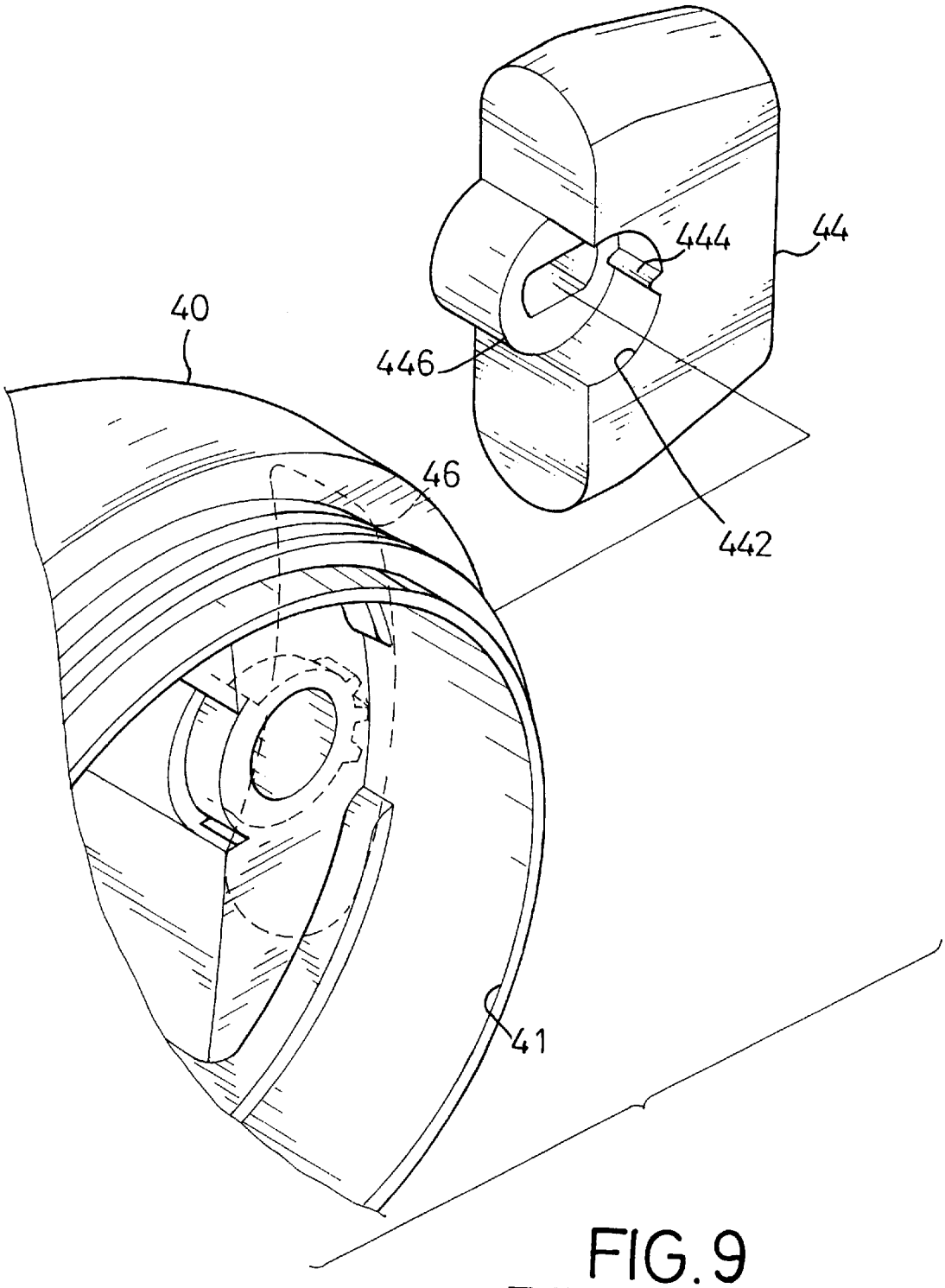
FIG. 9 PRIOR ART
FIG. 9 is an enlarged exploded perspective view of the head, the button and the side recess of the conventional showerhead in FIG. 8.
Figure 10:
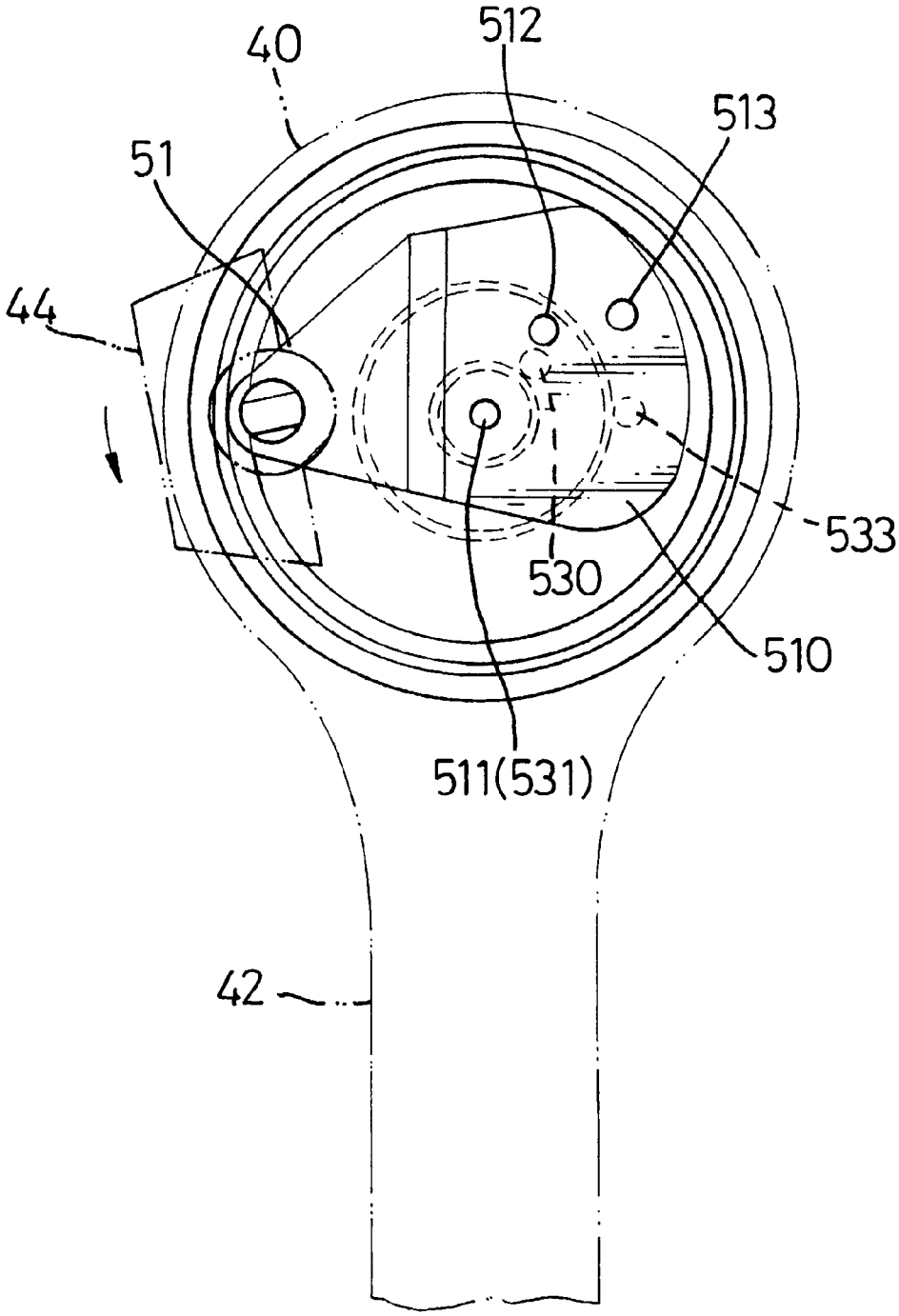
FIG.10 PRIOR ART
FIG. 10 is an operational front plan view in partial section of the conventional showerhead in FIG. 8 with water flowing through the through holes in an inner portion of the showerhead.
Figure 11:
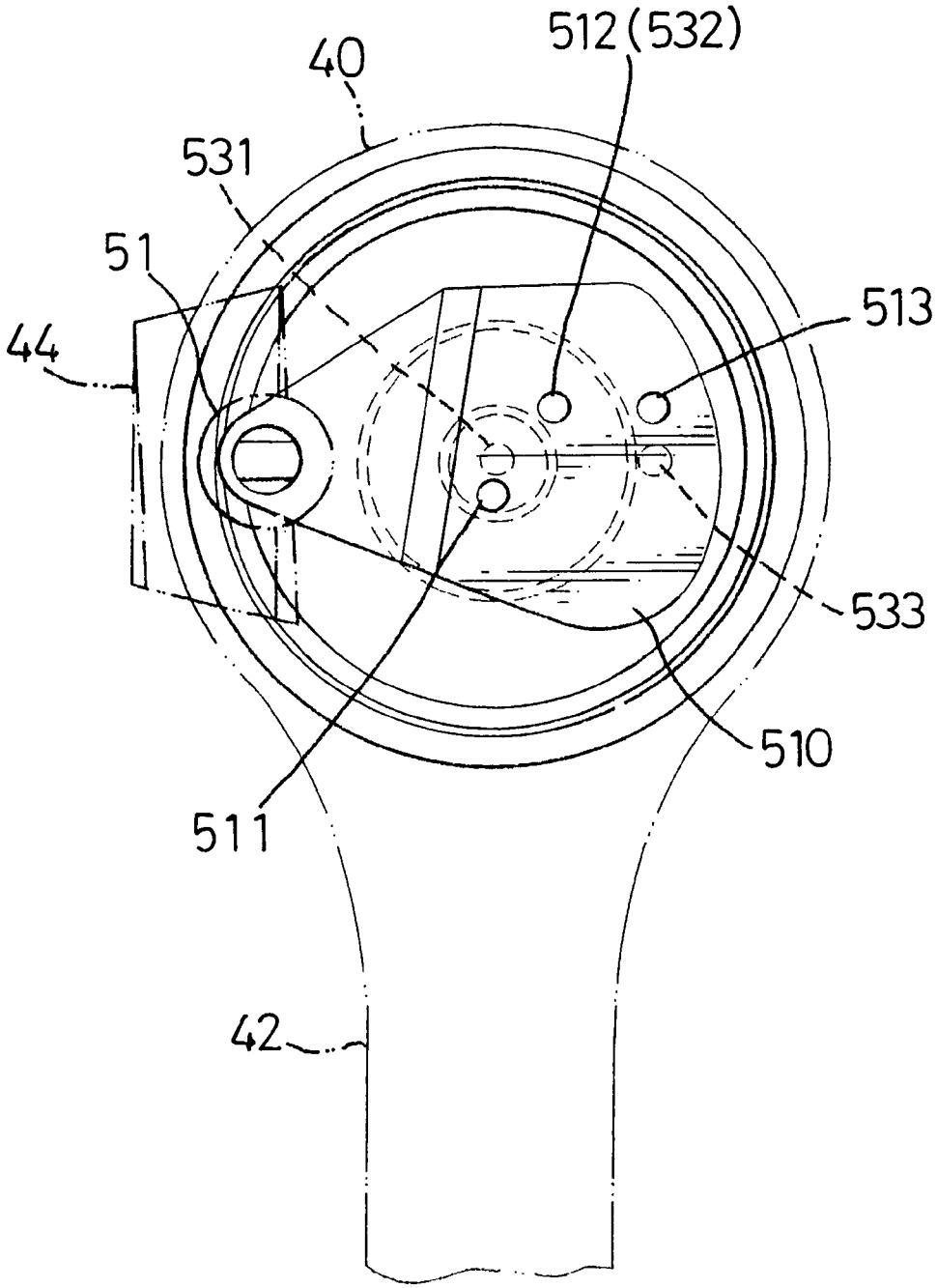
FIG.11 PRIOR ART
FIG. 11 is an operational front plan view in partial section of the conventional showerhead in FIG. 8 with water flowing through the through holes in a middle portion of the showerhead.
Figure 12:
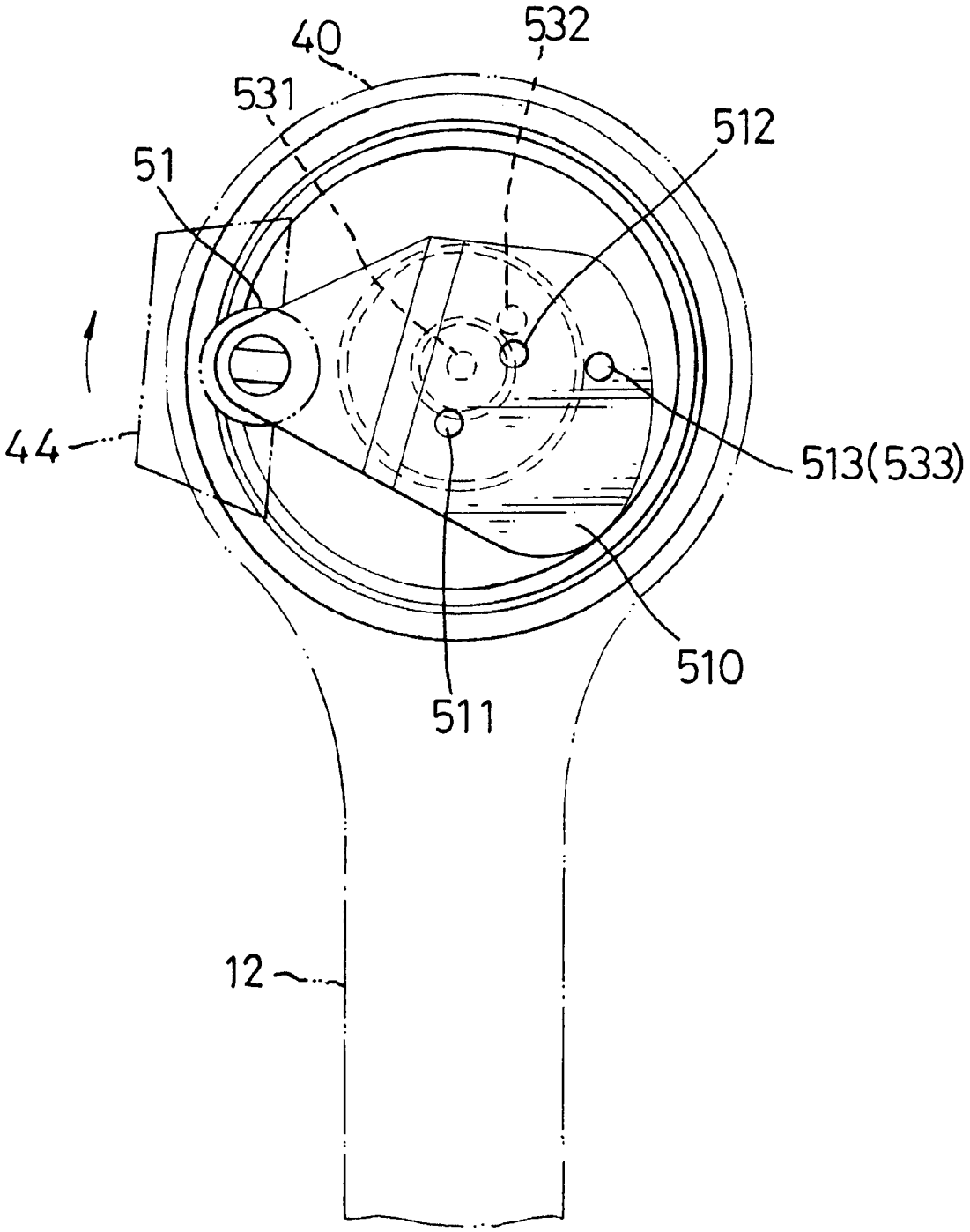
FIG.12 PRIOR ART
FIG. 12 is an operational front plan view in partial section of the conventional showerhead in FIG. 8 with water flowing through the through holes in an outer portion of the showerhead.

With reference to FIG. 1 and 2, a multi-nozzle showerhead comprises a showerhead housing (20), a rectangular tube (10) and multiple nozzles (30).

The showerhead housing (20) comprises a rear housing (21), seals (not numbered) and a front housing (22). The rear housing (21) has multiple inner stubs (not numbered), and each of the inner stubs has a distal end (not numbered) and a proximal end (not numbered). The proximal end is formed integrally with the rear housing (21), and a threaded hole (not numbered) is formed axially in the distal end.

The rectangular tube (10) comprises a front (not numbered), a bottom (not numbered), tube recesses (11, 12), seals and a connector (not numbered). The connector connects the bottom of the tube (10) to an exterior tube (not numbered), and the tube recesses (11, 12) are formed on the front of the rectangular tube (10). Each tube recess (11, 12) has an annular groove (not numbered), and the annular groove is formed around each recess (11, 12). Each seal (not numbered) is respectively mounted in each annular groove to prevent water leakage.

The front housing (22) comprises a front surface (not numbered), a rear surface (not numbered), seals (not numbered) and at least two nozzle recesses (221). Each nozzle recess (221) is formed on the front surface of the front housing (22) and has a recessed surface (not numbered) and screws (not numbered). The recessed surface has stub holes (not numbered), nozzle inlet holes (223), an axial through hole (not numbered) and an annular groove (not numbered). The annular groove is formed around the axial through hole. The stubs in the rear housing (21) respectively abut the stub holes in the front housing (22), and screws extend respectively through the stub holes and screw onto the threaded axial holes in the stubs to fasten the front housing (22) to the rear housing (21). The rear surface of the front housing (22) is securely connected to the rear housing (21) with the rectangular tube (10) clamped between the front housing (22) and the rear housing (21). The tube recesses (11, 12) are respectively extending through the corresponding nozzle inlet holes (223). One of the seals is securely mounted around the axial through hole, and the other one of the seals is mounted in the recess surface to prevent water leakage.

With reference to FIGS. 2, 3, 4 and 6, the multiple nozzles (30) are rotatably mounted respectively in the nozzle recesses (221). Each of the nozzles (30) comprises a selection valve (31), a diffuser housing (34), a circular impeller (36), a radial impeller (35), a diffuser (37) and a fastener (33).

The fastener (33) is a bolt (not numbered) and a nut (not numbered). The bolt has a enlarged head (not numbered) and a threaded shaft (not numbered). The enlarged head has a larger diameter than the axial through hole in recessed surface of the nozzle recess (221) in the front housing (22).

The selection valve (31) has an central through hole (not numbered), at least one inner water hole (311), at least one outer water hole (312), a front outer flange (not numbered), a front outer groove (not numbered), a front surface (not numbered), a rear outer groove (not numbered), a rear annular groove (not numbered), a rear surface (not numbered) and seals (not numbered). The rear annular groove is formed around the central through hole on the rear surface, and the annular groove of the selection valve (31) has a larger diameter than the annular groove in the nozzle recess (221). The rear annular groove in the selection valve (31) abuts the annular groove in the nozzle recess (221) when the selection valve (31) is securely mounted in the nozzle recess (221). A cylindrical gap (not numbered) is formed between the selection valve (31) and the nozzle recess (221). The at least one inner water hole (311), at least one outer water hole (312) and the axial hole extend through the selection valve (31). One of the seals is mounted in the front outer groove of the selection valve (31), one of the seals is mounted in the rear outer groove, and one of the seals is mounted around the inner circular groove. Seals are used to prevent water leakage when the selection valve (31) is securely mounted in the nozzle recess (221) and water fills the nozzle (30). Another seal is mounted in the front surface of the selection valve (31). The rear surface of the selection valve (31) is mounted in the nozzle recess (221).

The diffuser housing (34) has a front surface (not numbered), a rear surface (not shown), a rear protrusion (not numbered), a front protrusion (343), a circular inner flange (no numbered), a circular outer flange (not numbered), outer grooves (not numbered), at least one inner water hole (341), at least one outer water hole (342), a central through hole (not numbered) and an inner lip (not numbered). The front protrusion (343) has multiple lips (not numbered). The front protrusion (343) extends from the front surface of the diffuser valve (34), and the circular protrusion extends from the rear surface of the diffuser valve (34). The at least one inner and outer water holes (341, 342) and the central through hole extend through the diffuser housing (34). The circular outer and inner flanges are formed between the inner and outer protrusions of the diffuser housing (34). The inner lip is formed on the front surface of the diffuser housing (34). Seals are respectively mounted in the outer grooves of the front protrusion, one of the seals is mounted abutting the circular inner flange and one of the seals is mounted in one of the outer grooves abutting the rear protrusion. The rear surface of the diffuser housing (34) is rotatably connected to the selection valve (31).

The circular impeller (36) has a central through hole (not numbered) and at least one slanted triangular through hole (not numbered). The radial impeller (35) has a hollow central shaft (not numbered) and fins (not numbered). The fins include an interrupt fin (351), and the fins are radially formed on the central shaft of the radial impeller (35).

The diffuser (37) has a front surface (not numbered), a rear surface (not numbered), an end cap (not numbered) and a nut (not numbered). The rear surface has a circular protrusion (not numbered) and a diffuser groove (not numbered). The front surface has at least one inner water hole (371), at least one outer water hole (373) and a central through hole (not numbered). The inner and outer water holes (371, 373) have difference shapes. The inner and outer water holes (371, 373) and the central through hole extend through the diffuser (37). The diffuser groove is securely connected to the front protrusion of the diffuser housing (34). The circular groove in the diffuser (37) is securely connected to the inner lip of the diffuser housing (34), and the circular groove can direct water either to pass through the inner water hole (371) or to pass through the outer water holes (373). The radial impeller (35) is rotatably mounted between the diffuser (37) and the diffuser housing (34), and the circular impeller (36) is securely mounted in the diffuser protrusion of the diffuser (37). The nut and the end cap are screwed onto the bolt (33) to connect each of the nozzles in place by holding the selection valve (31), the diffuser housing (34), the circular and radial impellers (35, 36) and the diffuser (37) together.

With further reference to FIG. 4 through 7, the diffuser (37) is rotated with the diffuser housing (34) since the diffuser housing (34) is securely connected to the diffuser (37). The circular and radial impellers (35, 36) are rotatably mounted between the diffuser housing (34) and the diffuser (37). The diffuser housing (34) is rotated until the at least one inner water hole (341) in the diffuser housing (34) is aligned with the at least one inner water hole (311) in the selection valve (31), and water passes through the inner water holes (311, 341) and the slanted triangular through holes in the circular impeller (35), which causes the radial impeller (35) to rotate. When the radial impeller (35) rotates, the interrupt fin (351) momentarily blocks the water from passing through the impeller and creates a pulsation in the water from the showerhead. The pulsating water pattern provides a messaging water flow. The diffuser housing (34) is rotated until the at least one outer water hole (342) in the diffuser housing (34) is aligned with the at least one inner water hole (312) in the selection valve (31), and water passes through the outer water holes (312, 342), which provides another water pattern When water passes through the outer water holes (312, 342), the radial impeller (35) is not driven and the water does not pulsate.

The advantages of the multi-nozzle showerhead is that the multi-nozzle gives a broader shower area and each nozzle has selectable shower water patterns that include a pulsating water pattern that gives a messaging effect.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A multi-nozzle showerhead comprising;

a showerhead housing comprising a front housing, a rear housing and a tube;

the rear housing having an inner surface;

the tube comprising at least two tube recesses and a connector adapted to be connected to an exterior tube through which water can pass through the tube and the tub recesses;

the front housing comprising at least two nozzle recesses each with a recessed surface; each recessed surface comprising a nozzle inlet hole formed in the recessed surface and communicating with one of the at least two tube recesses in the tube so that the water passes through the nozzle inlet hole;

the front housing securely connected to the inner surface of the rear housing with the tube clamped between the front housing and the rear housing; wherein nozzle is rotatably mounted in each respective at least two nozzle recesses in the front housing, and each nozzle comprises a diffuser, a radial impeller, a circular impeller, a diffuser housing, a selection valve and seals; wherein the selection valve is securely mounted in the corresponding one of the at least two nozzle recesses in the front housing and has first water holes communicating with the corresponding one of the at least two tube recesses in the tube;

the diffuser housing is rotatably connected to the selection valve and has second water holes selectively communicating with the first water holes in the selection valve when the diffuser housing rotates relative to the selection valve;

the circular and radial impellers are securely mounted in the diffuser housing between the diffuser housing and the diffuser; the circular impeller has slanted through holes, and the radial impeller has a radial interrupt fin which momentarily interrupts water passing through the radial impeller during rotation of the radial impeller; the circular impeller is adapted to direct the direction of water flow, so the radial impeller keeps rotating; and the diffuser is securely connected to the diffuser housing, and the diffuser rotates with the diffuser housing and has third water holes communicating with the second water holes in the diffuser housing to select a particular water patterns.

2. The multi-nozzle showerhead as claimed in claim 1, wherein the first water holes in the selection valve comprise at least one inner through hole through which the water coming out of corresponding nozzle inlet hole passes.

3. The multi-nozzle showerhead as claimed in claim 2, wherein the first water holes in selection valve has at least one outer through hole through which water coming out of corresponding nozzle inlet hole can pass.

4. The multi-nozzle showerhead as claimed in claim 3, wherein the second water holes in the diffuser housing has at least one inner through hole selectively communicating with the at least one inner through hole in the selection valve and through which water coming out of the at least one inner through hole in the selection valve passes.

5. The multi-nozzle showerhead as claimed in claim 4, wherein the second water holes in the diffuser housing has at least one outer through hole selectively communicating with the at least one outer through hole in the selection valve and through which water coming out of the at least one outer through hole in the selection valve passes.

6. The multi-nozzle showerhead as claimed in claim 5, wherein the third water holes in the diffuser has at least one inner through hole communicating with the at least one inner through hole in the diffuser housing and through which water coming out of the at least one inner through hole in the diffuser housing can passes.

7. The multi-nozzle showerhead as claimed in claim 6, wherein the third water holes in the diffuser has at least one outer through hole communicating with the at least one outer through hole in the diffuser housing and through which water coming out of the at least one outer through hole in the diffuser housing can passes; and the diffuser has a circular groove securely connected to an inner lip formed on the diffuser housing, and the circular groove directs water either to pass through the at least one inner through hole in the diffuser or to pass through the at least one outer through hole.

8. The multi-nozzle showerhead as claimed in claim 7, wherein the inner surface of the rear housing has inner stubs, and each stub has a threaded hole;

the recessed surface of the front housing has stub holes; and multiple screws respectively extend through the stub holes and is screwed into the threaded holes in the inner stubs to connect the front housing to the rear housing.

9. The multi-nozzle showerhead as claimed in claim 1, wherein the selection valve has a front outer groove, a rear outer groove and a inner circular groove; seals are respectively mounted in the front outer groove, the rear outer groove and the inner circular groove to prevent water leakage.

10. The multi-nozzle showerhead as claimed in claim 1, wherein the diffuser housing has a circular inner flange, a circular outer flange and outer grooves; seals are respectively mounted in the outer grooves and abutting the inner flange to prevent water leakage.

* * * * *